US005518137A

United States Patent [19]

Hayes

[11] Patent Number: 5,518,137

[45] Date of Patent: May 21, 1996

[54] APPARATUS FOR HANDLING YARD DEBRIS

[76] Inventor: Michael R. Hayes, 125 Elwood Dr., Rochester, N.Y. 14616

[21] Appl. No.: 519,083

[22] Filed: Aug. 24, 1995

[51] Int. Cl.[6] ..... B65D 25/00

[52] U.S. Cl. ..... 220/404; 220/908

[58] Field of Search ..... 220/404, 403, 220/908

[56] References Cited

U.S. PATENT DOCUMENTS

| | | | |
|---|---|---|---|
| 3,321,103 | 5/1967 | Phillips | 220/404 |
| 3,807,598 | 4/1974 | Nutt | 220/404 |
| 3,893,725 | 7/1975 | Coulter et al. | 220/908 X |
| 4,027,774 | 6/1977 | Cote | 220/404 |
| 4,254,602 | 3/1981 | Boynton | 220/908 X |
| 4,280,676 | 7/1981 | Betts | 220/908 X |
| 4,932,557 | 6/1990 | Yeo | 220/404 |
| 4,953,740 | 9/1990 | Koda | 220/404 X |
| 4,976,371 | 12/1990 | Wise et al. | 220/908 X |
| 5,056,679 | 10/1991 | Lonczak | 220/908 X |
| 5,372,269 | 12/1994 | Sutton et al. | 220/908 X |

*Primary Examiner*—Steven M. Pollard
*Attorney, Agent, or Firm*—Robert J. Bird

[57] ABSTRACT

A debris handling device includes a cylindrical barrel with an open top and bottom and an annular ring within the open top. A bag is mounted in the barrel, hanging from and held open by the top rim of the barrel. The bag is releasable, and the barrel upwardly removable from the bag. The annular ring includes a notch to receive the twisted neck of the bag, and a hasp to close over the notch to hold the bag closed and in place so the barrel can be rolled.

1 Claim, 1 Drawing Sheet

APPARATUS FOR HANDLING YARD DEBRIS

CROSS-REFERENCE TO RELATED APPLICATION

This is a substitute for my earlier applicaton Ser. No. 08/283,620; filed Aug. 1, 1994; now abandoned.

FIELD OF THE INVENTION

This invention is a device for handling leaves, grass cuttings, and other yard debris. More specifically, it is a combination receptacle, compacter, and transporter for removal of leaves or debris to the streetside or compost pile.

BACKGROUND INFORMATION

It was once a common practice to dispose of leaves by raking them into piles for burning. For environmental reasons, leaves are no longer burned but are instead piled at the streetside for pickup. The leaves are raked to the streetside; or raked onto a sheet and dragged to the streetside; or raked into piles, placed in rubbish containers, and carried to the streetside.

Loosely piled leaves are likely to be scattered by wind before they are picked up. Loose leaves also find their way into storm drains and sewers, sometimes requiring costly removal. Placing leaves in rubbish barrels prevents them from blowing but, depending on the number of trees and size of the yard, it may require a lot of barrels to hold the leaves after each raking. And, if leaves are packed into the barrels by foot, they are difficult to remove. The barrel with its compacted contents must be inverted and shaken (or thrown upside down on the ground) to dislodge the contents. My invention provides a better way to do all this.

U.S. Pat. No. 5,372,269 to Sutton et al. was cited as prior art in my earlier application, referenced above. Sutton discloses a cylindrical container with hooks around its open top with which to secure a plastic bag in place.

SUMMARY OF THE INVENTION

The present invention is a debris handling device, including a cylindrical barrel with an open top and bottom and an annular ring within the open top. A bag is mounted in the barrel, hanging from and held open by the top rim of the barrel. The bag is releasable, and the barrel upwardly removable from the bag. The annular ring includes a notch to receive the twisted neck of the bag, and a hasp to close over the notch to hold the bag closed and in place so the barrel can be rolled.

DRAWING

DESCRIPTION

Figure 1:
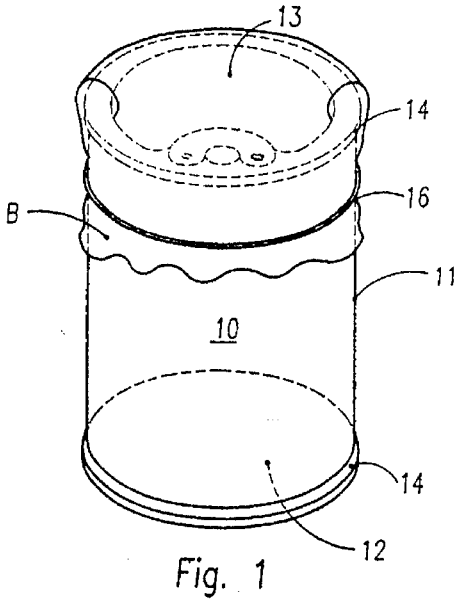
FIG. 1 shows an upright barrel according to this invention.

Referring to FIG. 1, my debris handling device includes a barrel 10 with a straight cylindrical sidewall 11, a fully open bottom 12, and an open top 13 with an inner annular ring 15. Circumferential metal rims 14 at top and bottom give the barrel rigidity and durability. The barrel 10 is about 30 inches high and about 24 inches in diameter. A plastic rubbish bag B is shown placed in the barrel 10 with its open top folded back down over the top of the barrel. An elastic band 16 holds the bag in place over the outside of the barrel. The barrel 10 supports the rubbish bag B in position as an upright and open receptacle. The barrel 10 and bag B combine to form a plastic lined receptacle.

As I rake leaves into convenient piles, I move the barrel 10 to the pile and put leaves into the bag B. From time to time, I pack the leaves down with my feet to make room for more. The barrel has no bottom, so I can stand in it to compact the leaves without damaging the barrel. When the bag B is sufficiently full and compacted, I grasp the inner edge of the annular ring 15, and drag the barrel to its destination, e.g. streetside or compost pile. I remove the elastic band and close the bag over its contents. I then simply lift the open-bottom barrel straight up, leaving behind a compacted upright bag of leaves. The barrel is now empty and ready to repeat the process with another bag and more leaves. In this mode, the barrel 10 remains upright.

Figure 6:
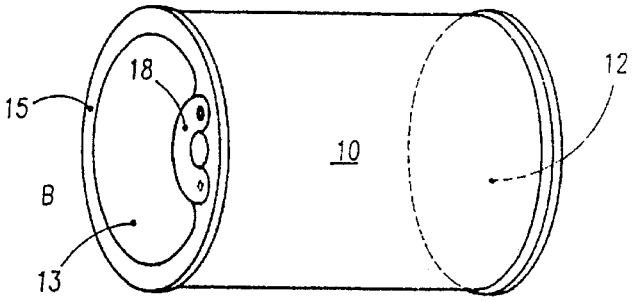
FIG. 6 shows the barrel lying on its side.

It may be preferable in some circumstances, for example if the yard is very large or its terrain is rough and uneven, to put the barrel 10 on its side, as in FIG. 6, and roll it from place to place. In that case, it is necessary to provide means to secure the barrel contents in place.

Figure 2:
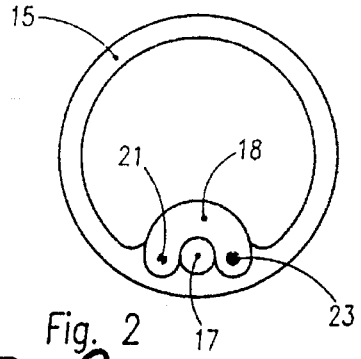
FIGS. 2 and 3 are top views of the barrel.
Figure 3:
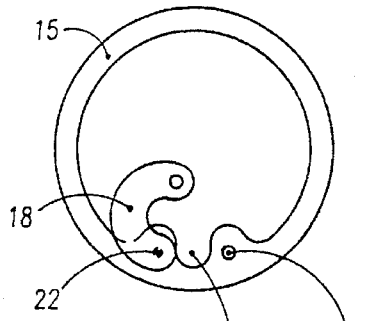

FIGS. 2 and 3 show the top of the barrel 10. The annular ring 15 includes a notch 17 and a curved hasp 18 movable between an open position (FIG. 3) and a closed position over the notch 17 (FIG. 2). The twisted neck N of the bag B is positioned in the notch 17 and clamped in place by the hasp 18 to keep the filled plastic bag B in place as the barrel is rolled.

Figure 4:
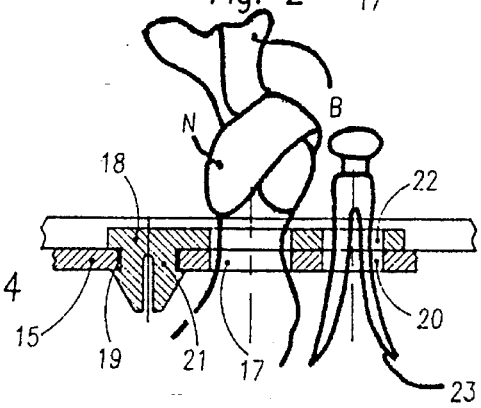
FIG. 4 is an enlarged sectional view taken on the line 4—4 of FIG. 2.

FIG. 4 is an enlarged sectional view showing the locking hasp 18 and a portion of the annular ring 15. The annular ring 15 includes holes 19 and 20 on opposite sides of the notch 17. The hasp 18 includes a pivot pin 21 at one end which is tapered and elastically deformable for a snap fit into the hole 19 in the annular ring 15. The hasp 18 includes a hole 22 at its other end. When the hasp 18 is closed over the annular ring 15 (FIG. 2) and their respective holes 22, 20 are aligned, the hasp 18 is locked closed by a resilient lock pin 23 through the aligned holes. FIG. 4 further represents the twisted and knotted neck N of the bag B clamped in place in the notch 17 by the hasp 18.

Figure 5:
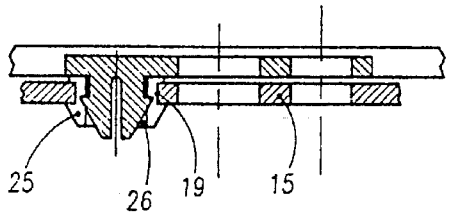
FIG. 5 is a sectional view of a modified form of the details in FIG. 4.

In FIG. 5, the hole 19 in the annular ring 15 is lined with a bushing 25 which is tapered and elastically deformable to snap into the hole 19, providing a more durable hinge bearing for the pivoting hasp 18. The hasp pivot pin 21 snaps into the center hole 26 of the bushing 25.

A plastic rubbish bag by itself, without the supporting structure of my barrel, is not adequate as a receptacle for yard debris. Twigs put into the bag always poke themselves through it, often to such an extent that the bag no longer has enough strength or integrity to be lifted and moved. With this invention, the rubbish bag is reinforced while it is being filled, and twigs will not poke and extend themselves through it.

The use of my system results in a neat and compact pile, which will facilitate its collection, either manually or with equipment.

The foregoing description is illustrative. The concept and scope of the invention are limited only by the following claims and equivalents thereof.

What is claimed is:

1. A debris handling device, including:

a cylindrical barrel with an open bottom and an open top;

an annular ring disposed within said open top;

a bag releasably mounted within said barrel and held open by the open top of said barrel;

said annular ring including releasable clamping means to close the top of said bag having a twisted neck and to secure said bag in place for rolling said barrel;

said barrel being upwardly removable from said bag; a notch in said annular ring to receive the twisted neck of said bag;

a hasp operatively connected to said annular ring to close over said notch and the neck of said bag to hold said bag closed and in place;

said hasp including a curved body with a pivot pin extending from one end portion thereof for snap engagement with said annular ring, said hasp being pivotally movable on said pivot pin in a plane parallel to said annular ring between open and closed positions relative to said notch, and means to secure said hasp in said closed position.

* * * * *